US007721467B2

(12) United States Patent
Cheskin et al.

(10) Patent No.: US 7,721,467 B2
(45) Date of Patent: May 25, 2010

(54) SHOE INSOLE WITH IMPROVED SUPPORT AND MOTION CONTROL

(75) Inventors: Melvyn P. Cheskin, Deerfield Beach, FL (US); Ray M. Fredericksen, Haslett, MI (US)

(73) Assignee: Spenco Medical Corporation, Waco, TX (US)

( * ) Notice: Subject to any disclaimer, the term of this patent is extended or adjusted under 35 U.S.C. 154(b) by 832 days.

(21) Appl. No.: 11/556,081

(22) Filed: Nov. 2, 2006

(65) Prior Publication Data

US 2007/0107261 A1 May 17, 2007

Related U.S. Application Data

(60) Provisional application No. 60/732,799, filed on Nov. 2, 2005.

(51) Int. Cl.
*A43B 13/38* (2006.01)
*A43B 13/18* (2006.01)

(52) U.S. Cl. ..... 36/44; 36/28

(58) Field of Classification Search ..... 36/44, 36/28, 43, 30 R, 166, 173, 174, 180
See application file for complete search history.

(56) References Cited

U.S. PATENT DOCUMENTS

| | | | | |
|---|---|---|---|---|
| 2,790,254 | A * | 4/1957 | Burns | 36/178 |
| 2,857,689 | A * | 10/1958 | Van Ostrom et al. | 36/176 |
| 4,597,196 | A | 7/1986 | Brown | 36/44 |
| 4,633,877 | A * | 1/1987 | Pendergast | 36/140 |
| 5,014,706 | A * | 5/1991 | Philipp | 36/140 |
| 5,184,409 | A * | 2/1993 | Brown | 36/44 |
| 5,669,162 | A | 9/1997 | Dyer | 36/44 |
| 6,070,342 | A * | 6/2000 | Brown | 36/44 |
| 6,233,847 | B1 | 5/2001 | Brown | 36/44 |
| 6,598,319 | B2 * | 7/2003 | Hardt | 36/28 |
| 6,618,960 | B2 | 9/2003 | Brown | 36/44 |
| 6,880,266 | B2 * | 4/2005 | Schoenborn et al. | 36/28 |
| 2002/0050080 | A1 | 5/2002 | Vasyli | 36/145 |
| 2002/0092203 | A1 | 7/2002 | Hardt | 36/43 |
| 2003/0093920 | A1 | 5/2003 | Greene et al. | 36/25 |
| 2004/0025374 | A1 | 2/2004 | Basso | 36/10 |
| 2004/0118017 | A1 | 6/2004 | Dalton et al. | 36/44 |
| 2004/0194344 | A1 | 10/2004 | Tadin | 36/44 |

FOREIGN PATENT DOCUMENTS

| | | | |
|---|---|---|---|
| EP | 0 774 219 | A2 | 5/1997 |
| WO | WO 2006/035469 | A2 | 4/2006 |
| WO | WO 2007/021328 | A1 | 2/2007 |

OTHER PUBLICATIONS

PCT "International Search Report and Written Opinion", dated Mar. 13, 2007, for counterpart International Patent Application No. PCT/US2006/042885.

PCT "International Search Report and Written Opinion", dated Jul. 27, 2006, for counterpart International Patent Application No. PCT/US2006/014681.

* cited by examiner

*Primary Examiner*—Ted Kavanaugh
(74) *Attorney, Agent, or Firm*—Hemingway & Hansen LLP; Eugenia S. Hansen

(57) ABSTRACT

An insole providing cushioning and control of foot motion. The insole includes a base. A lateral border and a medial border cooperate to align and support the foot. The lateral border and medial border are firmer than the base.

21 Claims, 2 Drawing Sheets

SHOE INSOLE WITH IMPROVED SUPPORT AND MOTION CONTROL

The present application claims priority to U.S. Provisional application No. 60/732,799 for SHOE INSOLE, filed Nov. 2, 2005, which application is incorporated herein in its entirety by this reference.

The present invention relates in general to an improved shoe insole and more particularly to an insole for women adapted to provide improved cushioning, support, and motion control.

BACKGROUND OF THE INVENTION

The human foot is a very complex biological mechanism. While standing, the feet carry a persons entire weight. While walking the load on a foot at heel strike is typically about one and a half times a person's body weight. When running or carrying extra weight the loads on the foot may exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions and protect the foot from injury.

To be practical for distribution to the general public, an insole must be able to provide benefit to the user population without requiring individualized adjustment and fitting. Insoles can be optimized to address the needs of different portions of the user population. For example, insoles can be designed to accommodate the biomechanical differences between men and women.

Biomechanically men and women are very similar in most respects. They share basically the same human design, with the same number of bones, muscles, ligaments, and a torso that supports two upper and lower limbs. However, there are some biomechanical differences. The most distinguishing anatomical feature between men and women is the pelvis. To facilitate child birth, the pelvis of a woman is typically broader and rounder than that of a man. As a result, in women the thigh bone or femur approaches the knee at a greater angle than in men. This angle, called the quadriceps angle or Q-angle, is, on average, about 18 degrees in women compared to about 13 degrees in men. This angulation places greater stress at the knee joint of most women, making them more vulnerable to misalignment injuries, such as anterior cruciate ligament tears at the knee, $4^{th}$ and $5^{th}$ metatarsal fractures, peroneal tendonitis, iliotibial band syndrome, and other injuries. Because women also typically have narrower heels and lighter bone structure across the tri-planar axis of the foot, they are more susceptible to over use injuries and compensatory injuries when trying to reduce stress along the medial aspect of the knee joint Women compensate for a greater Q-angle by moving their center of mass laterally to the outside to place the leg in a straighter alignment over the foot. Women also tend to pronate more than men because their foot strikes the ground in a more supinated position on the outside of their feet during foot strike.

In view of the foregoing, it would be desirable to provide an over-the-counter insole that provides cushioning adapted to the biomechanics of women.

It would also be desirable to provide an insole that provides pronation control adapted to the unique biomechanics of women.

SUMMARY OF THE INVENTION

The above, and other objects and advantages of the present are provided by an insole that provides both motion control and cushioning. The insole includes a system of interacting components that cooperate to achieve a desired combination of foot cushioning and motion control. The components include a base, a lateral and medial cradle, a heel plug, and a number of elastomeric pads. The characteristics of these components, their size and shape, and their position are selected to provide a desired blend of cushioning and control, and more specifically to achieve a desired biomechanical function.

In accordance with principles of the present invention, a cushioning base is combined with firmer pads along the medial side, lateral side, and rear of the foot to form a cradle to support the foot while providing cushioning, stability, and control. Additional elastomeric pads under the heel and forefoot provide additional cushioning. By altering the size, shape, and material properties of the pods insoles may be designed to address issues related to foot motion.

BRIEF DESCRIPTION OF THE DRAWINGS

The above, and other objects and advantages of the present invention will be understood upon consideration of the following detailed description taken in conjunction with the accompanying drawings, in which like reference characters refer to like parts throughout, and in which.

DETAILED DESCRIPTION

Figure 1:
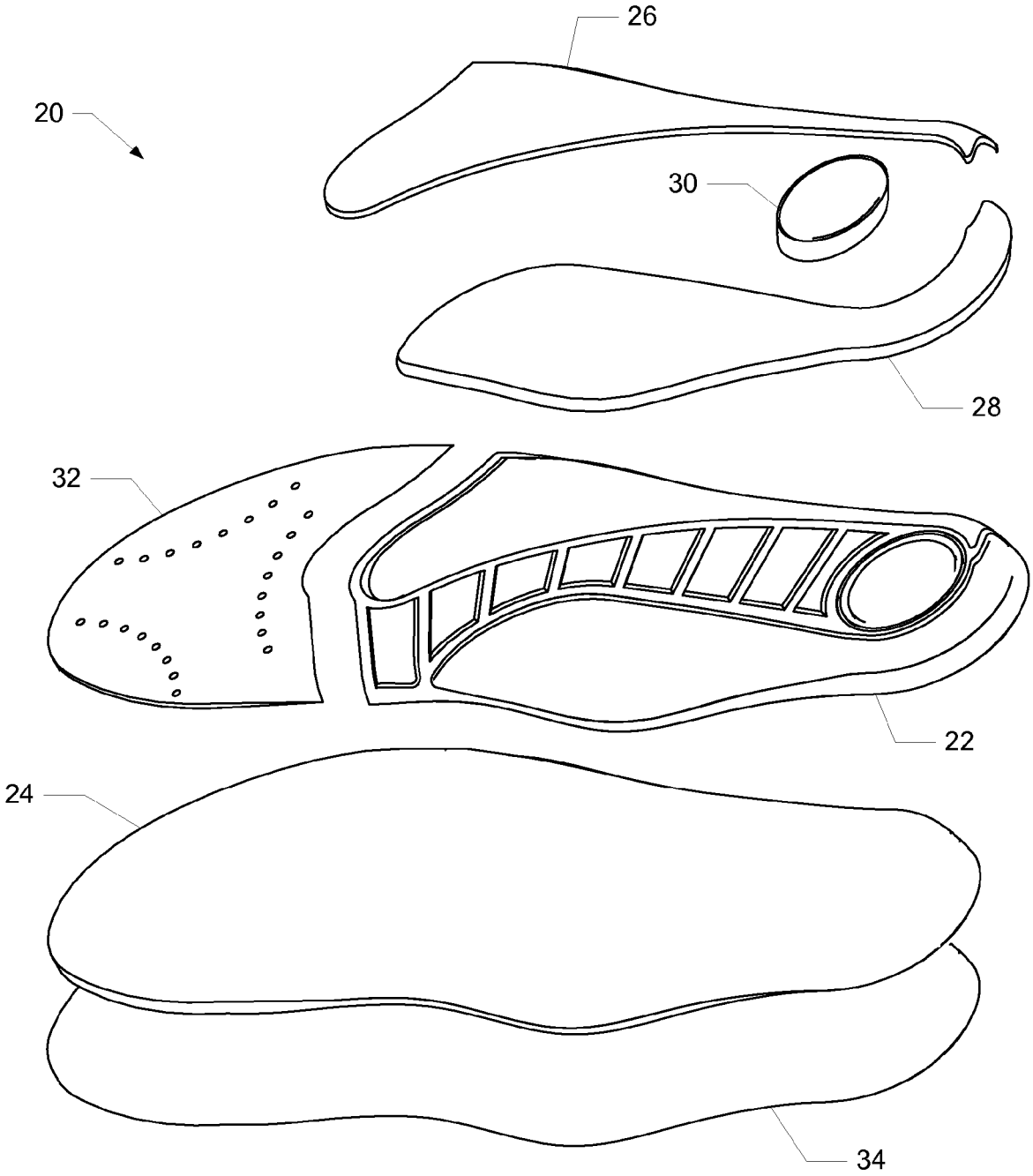
FIG. 1 is a exploded perspective view of an illustrative embodiment of an insole in accordance with the principles of the present invention.
Figure 3:
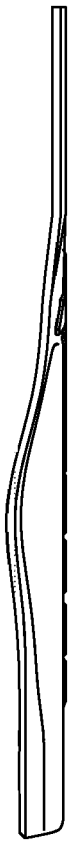
FIGS. 2 to 4 are, respectively, plantar (bottom), medial (inside), and lateral views of the insole of FIG. 1.
Figure 2:
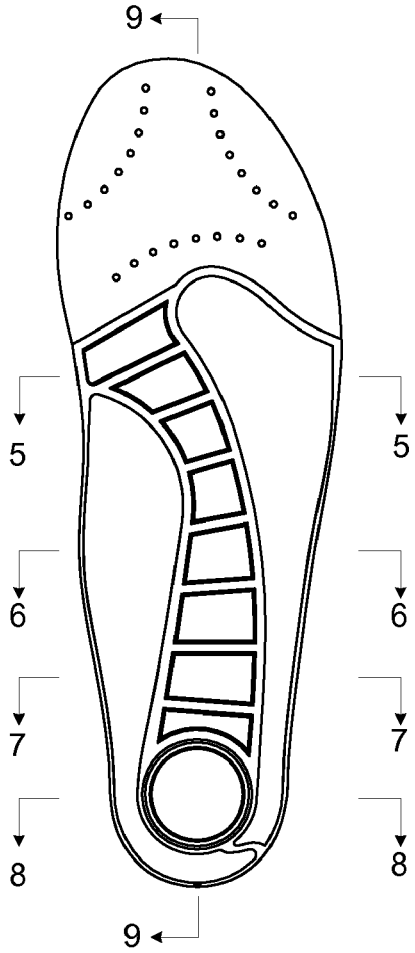
Figure 4:
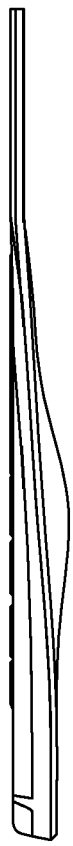
Figure 9:
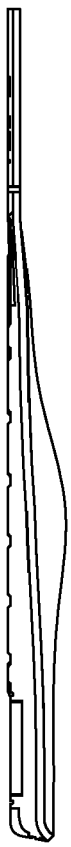
FIG. 9 is a longitudinal cross sectional view of the insole of FIG. 2.
Figure 5:
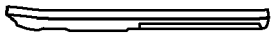
FIGS. 5 to 8 are transverse cross sectional views of the insole of FIG. 2.
Figure 6:
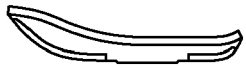
Figure 7:
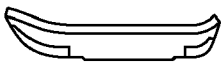
Figure 8:
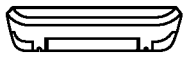

In reference to FIGS. 1 to 9, an insole constructed in accordance with the principles of the present invention is disclosed. The insole is for use inside a user's shoe and has a shape which will generally conform to the inside of a shoe. As shown in the exploded view of FIG. 1, insole 20 is a composite structure including base 22, cushioning pad 24, lateral border 26, medial border 28, heel plug 30, forefoot pad 32, and top sheet 34.

As shown in FIG. 1, base 22 generally has the shape of a partial insole extending from behind the heel to the area of the forefoot. Base 22 is made of a foam or other durable material having suitable cushioning and support properties. For example, base 22 is preferably made of a polyurethane foam of about 3 to 12 mm thick and having a durometer of about 49 to 53 Asker C.

Base 22 has a raised edge that wraps around the heel and extends partially along the sides of the foot such that the insole conforms to the natural shape of the foot. As best seen in FIGS. 5-9, the height of the raised edge is generally higher, and the base material is thicker, on the medial side of the foot and is lower on the lateral side. Base 22 includes thicker portions in the shape of pods generally along a centerline of the foot. Base 22 further includes indented areas or regions designed to accept various pads and plugs as discussed below. Preferably, the base extends from the heel through the midfoot area and defines a first recess in the bottom of the base and extending along a lateral side of the base for receiving a lateral border as specified below and a second recess in the bottom of the base and extending from behind the heel along the medial side of the base through the longitudinal arch for receiving a medial border as specified below.

Cushioning pad 24 is disposed on the upper surface of base 22 and generally extends under the entire foot, from the heel to the toes. Cushioning pad is made of a softer cushioning material than base 22 to control and distribute the initial impact of foot strike. For example, cushioning pad 24 is preferably a neoprene foam layer about 2 to 3 mm thick and having a durometer of about 21 Asker C.

An upper surface of cushioning pad 24 is covered with top sheet 34, which is preferably a non-woven fabric layer with a low coefficient of friction so as to minimize the possibility of blisters. The fabric is treated with an antibacterial agent, which in combination with a moisture barrier reduces odor causing bacteria and fungus. A series of air ports extending through insole 20 permit air circulation above and below insole 20.

Lateral border 26 and medial border 28 cooperate to form a cradle that generally extends from the heel through the midtarsal joints of the foot. Lateral border 26 extends along the lateral side of the foot from beside the calcaneous to the forefoot. Medial border 28 wraps around behind a portion of the calcaneous and extends along the inside of the foot through the arch to support and cushion the inside of the foot. The lateral and medial borders are secured to the lateral and medial recesses respectively in the base. Lateral cradle 26 and medial cradle 28 are made of a firmer material than base 22. For example, lateral cradle 26 and medial cradle 28 are preferably made of a polyurethane material having a durometer in the range of about 60 to 70 Asker C. The use of pads or cushions made of materials of differing density, or hardness, in conjunction with the shape and placement of the pads provides cushioning and control to help compensate for the increased O-angle in women. The size, shape, and placement of these pads are based on the location of various anatomical landmarks of the foot and the biomechanics of foot motion.

As shown in FIGS. 5 to 9, lateral border 26 and medial border 28 wrap up the sides and/or rear of base 22 to provide support for the foot. The sides of stability medial border 28 are preferably higher than the lateral border because of the higher loading. For example, medial cradle 28 extends upward under the medial longitudinal arch to provide longitudinal arch support.

Biological tissues such as tendons and ligaments are sensitive to the rate at which they are loaded, the abrupt change in load may cause injury or damage. Together, base 22, lateral border 26, and medial border 28 function to place the female foot in better biomechanical alignment with the leg and to balance their anatomical structure to reduce compensatory injuries. The medial arch support provided by base 22 and medial border 28 slows down the rate of pronation and improves balance for the foot. The medial border 28 also cooperates with the rear portion of the lateral border 26 to provide added rearfoot stability. The lateral border 26 extends beyond the fifth metatarsal bone with a cuboid support that functions to lock the midtarsal at midstance.

A forefoot pad 32 may be a third pad or component in addition to the cushioning pad 24 and base 22 lateral border 26, medial border 28 as best illustrated in FIG. 1. It may be employed also with heel plug 30 and/or top sheet 34. It is disposed on a top surface of the base and extends forward of the base. The material of the forefoot pad is preferably from about 16 to 27 Asker C. Forefoot pad 32 is positioned under the toes of the foot to provide cushioning of the toes during toe off. For example, pad 32 may comprise a 1.5 mm layer of neoprene having a durometer of about 21 Asker C.

The base is preferably provided with a recess adapted to receive a heel pad or plug. Preferably, the heel pad or plug is made of a material having a firmness of about 17 to 28 Asker C. The heel plug may be one the five components in addition to the cushioning pad 24 and base 22 as best illustrated in FIG. 1 as lateral border 26, medial border 28 forefoot pad 32 and top sheet 34. The heel plug is preferably made of gel. Gel heel plug 30 fits into a recess in base 22 and provides additional cushioning at foot strike. Heel plug 30 preferably has a durometer of about 22 Asker C.

An upper surface of cushioning pad 24 is covered with top sheet 34, which is preferably a non-woven fabric layer with a low coefficient of friction so as to minimize the possibility of blisters. The fabric is treated with an antibacterial agent, which in combination with a moisture barrier reduces odor causing bacteria and fungus. A series of air ports extend through top sheet 34, cushioning pad 24, and forefood pad 32 to permit air circulation above and below insole 20.

While the present invention has been described in relation to preferred embodiments, the detailed description is not limiting of the invention and other modifications will be obvious to one skilled in the art. For example, in the illustrative embodiment of the invention disclosed above the lateral and medial borders have the same firmness. However, over- or under-pronation may be addressed by using a material of different firmness.

The present invention has been disclosed in the context of providing an over-the-counter insole that may be made available for distribution to the general public. However, the same principles may be used by a podiatrist or other medical professional to design or create an insole to address the needs of a specific patient.

Thus, an improved insole has been disclosed. It will be readily apparent that the illustrative embodiment of an insole thus disclosed may be useful in cushioning the foot and controlling pronation. However, one will understand that the components of the insole system may be modified to achieve other ends. Thus, the description provided herein, including the presentation of specific thicknesses, materials, and properties of the insole components, is provided for purposes of illustration only and not of limitation, and that the invention is limited only be the appended claims.

What is claimed is:

1. An insole for use in a shoe, having a top surface for contacting the foot of a user and a bottom surface for contacting the interior of said shoe, a toe end and a heel end and two sides extending from said heel end to said toe end, the insole comprising:

(a) a cushioning pad defining a shape of said insole extending from said heel end to said toe end, said cushioning pad having a cushion upper surface and a cushion bottom surface, said shape defining a heel area, a forefoot area and a toe area, said cushioning pad made of a cushioning pad material which controls and distributes impact from a user's foot strike;

(b) a base made of a base material having support and cushioning properties firmer than said cushioning pad material, said base having a base upper surface and a base bottom surface said base upper surface having a raised edge that wraps around the heel and extends partially along the side edges of the insole such that the insole top surface conforms to the natural shape of a user's foot, said base upper surface defining the shape of a partial insole and attached to and extending from said heel end to said forefoot area of said cushioning pad, wherein said base bottom surface defines a thicker portion extending from said heel area to said forefoot region generally along a centerline of said insole, wherein said base bottom surface thicker portion further defines a plurality of pods, wherein said base bottom surface defines a medial indentation and a lateral indentation, said medial indentation extending from said heel through an arch area and said lateral indentation extending from said heel area to said forefoot region;

(c) a lateral border structure having a top lateral border surface and a bottom lateral border surface, said top lateral border surface secured to said lateral indentation of said base, wherein said lateral border is made of a border material, said border material firmer than said base material;

(d) a medial border structure having a top medial border surface and a bottom lateral border surface, said top medial border surface secured to said medial indentation of said base, wherein said medial border is made of a border material, said border material firmer than said base material;

whereby said lateral border structure and said medial border structure cooperate to form a cradle that generally extends from said heel area to an area of said insole which lies adjacent the midtarsal joints of a user's foot when in use.

2. The insole of claim 1 further comprising a forefoot pad attached to said cushion bottom surface extending from said forefoot area to said toe area.

3. The insole of claim 1 further comprising a top sheet secured to said cushion upper surface.

4. The insole of claim 1 wherein said base further defines a heel recess, and said insole further comprises a heel plug disposed in said heel recess.

5. The insole of claim 1 wherein the lateral border extends beyond an area of the insole corresponding to a user's fifth metatarsal bone when in use.

6. The insole of claim 1, wherein the firmness of the base material is in the range of 49-53 Asker C.

7. The insole of claim 1, wherein the firmness of the lateral and medial border material is in the range of about 60-70 Asker C.

8. The insole of claim 2, wherein the firmness of said forefoot pad is in the range of about 16 to 27 Asker C.

9. The insole of claim 4, wherein the firmness of said heel plug is in the range of about 17 to 28 Asker C.

10. The insole of claim 1, wherein said cushioning pad material is neoprene from about 2 to 3 mm thick having a durometer value of about 21 Asker C.

11. The insole of claim 1, wherein the firmness of the base, the lateral border, and the medial border are selected to compensate for the greater Q-angle in women.

12. A women's insole for use in a shoe which provides structure to compensate for the increased Q-angle women exhibit as compared with men, the women's insole having a top surface for contacting the foot of a user and a bottom surface for contacting the interior of said shoe, a toe end and a heel end and two sides extending from said heel end to said toe end, the insole comprising:

a cushioning pad defining a shape of said insole extending from said heel end to said toe end, said cushioning pad having a cushion upper surface and a cushion bottom surface, said shape defining a heel area, a forefoot area and a toe area, said cushioning pad made of a cushioning pad material which controls and distributes impact from a users foot strike;

a base made of a base material having support and cushioning properties firmer than said cushioning pad material, said base having a base upper surface and a base bottom surface, said base upper surface having a raised edge that wraps around the heel and extends partially along the side edges of the insole such that the insole top surface conforms to the natural shape of a user's foot, said base upper surface defining the shape of a partial insole and attached to and extending from said heel end to said forefoot area of said cushioning pad, wherein said base bottom surface defines a thicker portion extending from said heel region to said forefoot region generally along a centerline of said insole, wherein said base bottom surface thicker portion further defines a plurality of pods, wherein said base bottom surface defines a medial indentation and a lateral indentation, said medial indentation extending from said heel area through an arch area and said lateral indentation extending from said heel area to said forefoot area;

a lateral border structure having a top lateral border surface and a bottom lateral border surface, said top lateral border surface secured to said lateral indentation of said base, wherein said lateral border is made of a border material, said border material firmer than said base material; wherein said lateral border is made of a border material, said border material having a firmness greater than said base material of about 60 to 70 Asker C a medial border structure having a top medial border surface and a bottom lateral border surface, said top medial border surface secured to said medial indentation of said base, wherein said medial border is made of a border material, said border material firmer than said base material; wherein said medial border is made of a border material, said border material having a firmness greater than said base material of about 60 to 70 Asker C;

whereby said lateral border structure and said medial border structure cooperate to form a cradle that generally extends from said heel area to an area of said insole which lies adjacent the midtarsal joints of a user's foot when in use whereby said medial border structure and said base provide arch support and prevent pronation of a user's foot;

wherein said base further defines a heel recess, and said insole further comprises a heel plug disposed in said heel recess.

13. The insole of claim 12 further comprising a forefoot pad attached to said cushion bottom surface extending from said forefoot area to said toe area.

14. The insole of claim 13, wherein the forefoot pad comprises a material having a firmness of about 16 to 27 Asker C.

15. The insole of claim 13, wherein the forefoot pad comprises a layer of neoprene with a firmness of about 21 Asker C.

16. The insole of claim 15, wherein said layer of neoprene is about 1.5 mm thick.

17. The insole of claim 12, wherein said cushioning pad is made from a layer of neoprene having a durometer value of about 21 Asker C.

18. The insole of claim 17, wherein said neoprene is about 2 to about 3 mm thick.

19. The insole of claim 12, wherein said lateral border extends beyond the area of the insole which will lie adjacent the fifth metatarsal bone of a user's foot and provides a cuboid support that functions to lock the midtarsal at midstance.

20. The insole of claim 12, wherein said heel plug is made of a gel.

21. The insole of claim 20, wherein said gel has a durometer value of about 22 Asker C.

* * * * *